US006989184B2

(12) United States Patent
Duke et al.

(10) Patent No.: US 6,989,184 B2
(45) Date of Patent: Jan. 24, 2006

(54) POLYMERIC VOID-BOARD

(75) Inventors: David J. Duke, Salisbury, NC (US); William J. Williams, Wartburg, TN (US); John M. Kruelle, Glendale, AZ (US); Tilak R. Varma, Grayslake, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/803,398

(22) Filed: Mar. 18, 2004

(65) Prior Publication Data

US 2005/0204707 A1 Sep. 22, 2005

(51) Int. Cl.
*B65D 65/28* (2006.01)
*B32B 3/28* (2006.01)
*A47F 1/04* (2006.01)

(52) U.S. Cl. ..... 428/43; 428/167; 211/59.4

(58) Field of Classification Search ..... 428/43, 428/119, 120, 167; 211/49.1, 59.4; 206/322
See application file for complete search history.

(56) References Cited

U.S. PATENT DOCUMENTS 2,869,721 A 1/1959 Baumer
2,962,163 A 11/1960 Else
4,245,013 A * 1/1981 Clegg et al. ..... 429/144
4,465,729 A * 8/1984 Cancio et al. ..... 428/167
4,536,362 A * 8/1985 Donaldson ..... 264/173.17
5,946,878 A * 9/1999 Grund et al. ..... 52/630

FOREIGN PATENT DOCUMENTS

NL 6602815 9/1967

OTHER PUBLICATIONS

GB Patent Office Search Report; Jun. 7, 2005; Full Document.

* cited by examiner

*Primary Examiner*—Donald J. Loney
(74) *Attorney, Agent, or Firm*—Mark W. Croll, Esq.; Donald J. Breh, Esq.; Welsh & Katz, Ltd.

(57) ABSTRACT

An extruded polymeric void-board is configured for placement between adjacent horizontal layers of bricks to maintain an opening in a lower layer of the bricks. The void-board is formed as a relatively thin planar element having first and second surfaces. A plurality of parallel ribs extend from and generally transverse to the first side. The ribs have a predetermined height to width ratio and have a height that is less than a thickness of the planar element. The ribs being formed parallel to one another. A method for forming a bundle of bricks with the void-board is also disclosed.

11 Claims, 1 Drawing Sheet

POLYMERIC VOID-BOARD

BACKGROUND OF THE INVENTION

The present invention relates generally to a polymeric board used as a void-board. More particularly, the present invention relates to a profile-extruded void-board for use in forming bundles of bricks.

Bricks are typically "packaged" as a plurality of stacked individual units (i.e., bricks) formed into a 3-dimensional bundle. The bundle includes one or more package straps, corner protectors, and a veneer void-board, which is placed between two horizontal layers of bricks. Generally, the veneer void-board is placed above a layer of bricks that has bricks not present, e.g., forming two holes in the bundle. Additional layers of bricks are placed on top of the veneer board. The holes, which are typically centrally disposed, are configured to allow the prongs of a forklift or similar device to pass into the bundle. To move the package of bricks, the forklift will exert a force to the underside of the veneer, to lift the entire package. Typically, the holes are formed extending through the entire depth of the bundle.

Known void-boards have a number of drawbacks. For example, veneer void-boards are often times of poor quality. Known veneer boards have a tendency to warp. Warping and the attendant uneven surfaces upon which layers of bricks are stacked can result in package instability, and as a result, difficultly in package formation. In addition, known void-boards do not allow clean "separation" of the brick layers (in the depth direction) from the bundle. That is, there is no easy way to separate the bricks and sever or cut the board at the juncture of that layer and the remainder of the brick bundle. One solution explored in the past was to use a corrugated plastic sheet. However, the corrugated sheets tended to be crushed by the weight of the bricks. As a result the corrugated sheets were found to buckle in use.

Accordingly, there is a need for a void-board that is of consistent quality, consistency and strength to allow stable stacking of bricks for bundle forming without crushing the board. Desirably, such a void-board is readily severed for separating layers of bricks. Most desirably, such a void-board endures environmental conditions without warping.

SUMMARY OF THE INVENTION

An extruded polymeric void-board is configured for placement between adjacent horizontal layers of bricks to maintain an opening in a lower layer of the bricks. The opening is configured for insertion of a prong of a forklift for transporting the bundle of bricks.

The void-board is a relatively thin planar element having first and second surfaces. A plurality of parallel ribs extend from and are generally transverse to the first side. The ribs have a predetermined height to width ratio and have a height that is preferably less than a thickness of the planar element. The ribs are formed parallel to one another. The present void-board has a consistent quality, consistency and strength and allows stable stacking of bricks for bundle forming without crushing the board.

In a present void-board, the ribs are formed extending only from the first side of the planar element. The ribs are curved, having a semi-cylindrical profile. A present board has ribs that are formed on an on-center distance or spacing of about 0.10 inches to about and 0.20 inches, and preferably about 0.14 inches. The height to width ratio of the ribs is about 0.5.

Optionally, the void-board includes weakened regions formed in the planar element generally parallel to the ribs, between selected ones of the ribs. The weakened regions provide a plurality of frangible regions for separating the board. This permits separating vertical layers of bricks while maintaining the overall integrity and stability of the brick bundle.

Most desirably, such a void-board endures environmental conditions without warping. To this end, a present board is formed from polypropylene, polyethylene and a filler material. In one composition, the polyethylene is a linear low density polyethylene and the filler material is a cellulose fiber material.

A preferred composition is about 50 percent to about 80 percent polypropylene, about 20 percent to about 40 percent linear low density polyethylene and about zero percent to about 10 percent cellulose fiber filler material. More preferably, the board is about 65 percent polypropylene, about 30 percent linear low density polyethylene and about 5 percent filler material.

A method for forming and separating a bundle of bricks with the void-board is also disclosed.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
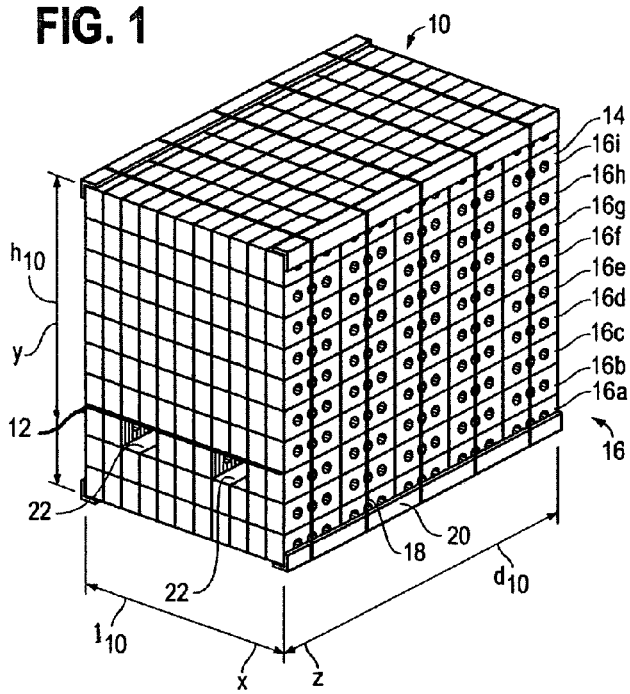
FIG. 1 is a perspective view of a bundle of bricks having a void-board embodying the principles of the present invention disposed between horizontal layers of bricks.

While the present invention is susceptible of embodiments in various forms, there is shown in the drawings and will hereinafter be described some exemplary and non-limiting embodiments, with the understanding that the present disclosure is to be considered an exemplification of the invention and is not intended to limit the invention to the specific embodiments illustrated.

It should be understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown a bundle of bricks 10 having a void-board 12 embodying the principles of the present invention. The bundle 10 is a 3-dimensional stack of bricks 14 (forming a matrix) that includes a plurality of horizontal layers, e.g., 16*a*–16*j*. The stack thus defines a length $l_{10}$, a height $h_{10}$ and a width $w_{10}$, which are represented by the x, y and z-axes as shown.

The bundle 10 is maintained in the 3-dimensional configuration by straps 18 that are positioned about the bundle 10. Vertical straps 18 (in the y-direction) can be positioned around the bundle extending in both the x and z-directions. Horizontal straps may not be used. Corner protectors 20 are disposed along the corners of the brick bundle 10 between the bricks 14 and strap 18 to protect the bricks 14 from damage due to rubbing and accidental bumping and to protect the strap 18 from failure due to, for example, abrasion.

In order to readily transport the bundle 10, openings 22 are formed in the bundle 10 by removing or eliminating bricks in a predetermined area of the matrix. The openings 22 are configured to permit the insertion of the prongs of a forklift. In this manner, the prongs can be inserted into the openings 22 and the bundle 10 raised and transported as desired.

Figure 3:
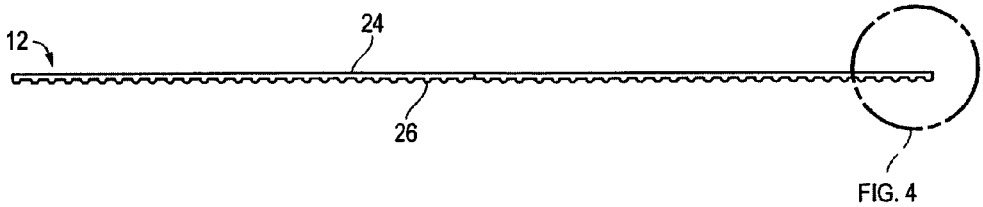
FIG. 3 is a side view of the void-board of the present invention.
Figure 4:
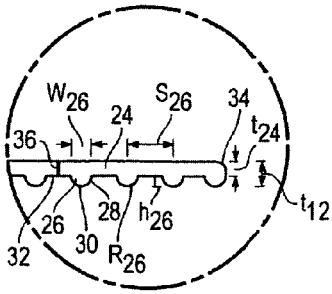
FIG. 4 is an enlarged view, as indicated in FIG. 3, illustrating the rib and board end profile.

To maintain the layer of bricks 16*d* above the opening 22, the void-board 12 is placed between the horizontal layers 16*c* and 16*d* of bricks, i.e., above the layer 16*c* in which the openings 22 are formed. An embodiment of the void-board 12 is illustrated in FIG. 3, which shows a profile of the polymeric void-board. The board 12 has a planar base element 24 having a thickness $t_{24}$ and includes a plurality of ribs 26 extending outwardly from the planar element 24. In a present board 12, the ribs 26 are parallel and are generally equal in height $h_{26}$ or distance from the planar base element 24. A terminal end 28 of each rib defines a peak 30. In a present embodiment, the ribs 26 are substantially solid, and the peaks 30 are rounded. In a present board 12 the base element has a thickness $t_{24}$ of about 0.025 inches to about 0.065 inches, preferably about 0.035 inches to about 0.045 inches, and most preferably about 0.040 inches.

The ribs 26 are formed having a semi-cylindrical profile extending along the surface 32 of the board 10. The ribs 26 have a radius $R_{26}$ of about 0.030 inches (and thus a height from the surface 32 of about 0.030 inches) and are formed at a spacing $S_{26}$ of about 0.10 to about 0.30 inches and preferably about 9/64 (0.14 inches) inches on center. Because the ribs 26 have a semi-cylindrical profile, the have a height $h_{26}$ to width $w_{26}$ ratio of about 0.5. The total thickness $t_{10}$ of the board 10 (the planar element 24 and the ribs 26) is thus about 0.070 inches, and at least 0.040 inches. A back end corner 34 of the board 10 (at the board end, opposite of the end rib) has a rounded profile with a radius of about 0.020 inches. It is anticipated that rib 26 configurations can be of many different sizes and shapes with a wide variety of height to width ratios, all of which are within the scope and spirit of the present invention.

Optionally, the void-board 12 can be formed having one or more weakened regions 36 formed in the planar element 24. The weakened regions 36 can be made by forming a score, crease or perforation in the element 24. The weakened regions 36 extend parallel to and between the ribs 26. The weakened regions 36 permit separating the board 12 after, for example, the bricks forming a vertical layer 38 of the bundle 10 (see FIG. 2) are removed. In this manner, the remaining board 12 is not extending out beyond the bundle 10 as would be with a solid sheet.

A present board 12 is formed from polyolefin blends with various fibrous or particulate filler materials. A present board is polypropylene (PP), linear low density polyethylene (LLDPE), and a filler material such as cellulose fibers. A preferred composition is about 50 percent to about 80 percent PP and about 20 percent to about 40 percent LLDPE. A more preferred composition is about 30 percent to about 40 percent PP, about 25 percent to about 35 percent LLDPE, and about 2 percent to about 8 percent cellulose. Most preferred is a composition of about 65 percent PP, about 30 percent LLDPE, and about 4 percent cellulose.

The void-board 12 is preferably an extruded member and, as such, the ribs 26 are formed integral with the planar element 24 (body) of the board 12. A present board 12 is formed having a density of about 0.7 grams per cubic centimeter (gm/cc) to about and 1.3 gm/cc, preferably about 0.85 gm/cc to about 1.15 gm/cc and most preferably about 1 gm/cc. It should be noted that 1 gm/cc is equal to a specific gravity of about 1.0. It is contemplated that the ribs 26 are formed in the machine direction of the board 12, e.g., as the board 12 is extruded, to facilitate manufacture. Such manufacture also results in a high strength board 12.

As seen in FIG. 1, the bundle of bricks 10 is maintained as a bundle by the straps 18, corner protectors 20, and void-board 12 embodying the principles of the present invention. The bricks 14 are arranged side-by-side to form a first horizontal layer 16*a*. Additional horizontal layers 16*b*–16*j* can be disposed above the first layer 16*a*. One of the layers, e.g., 16*c*, is then positioned on the stack with one or two rows of bricks removed, thus forming the sides and bottom of the fork lift prong openings 22. The void-board 12 is positioned on the open row layer 16*c*, and a full horizontal layer 16*d* of bricks is disposed on the void-board 12. The void-board 12 is positioned on the layer 16*c* such that the ribs 26 are perpendicular to the (longitudinal direction of the) fork prong openings 22. The ribs 26 are positioned downwardly, resting on the top of the lower layer 16*c* of bricks (as oriented in FIG. 3). Additional horizontal layers can be positioned on the layer 16*d* that is positioned on the layer overlying the void-board 12. Corner protectors 20 are positioned on the bundle 10 and the bundle 10 is strapped (with strap material 18) to secure the bundle 10.

Figure 2:
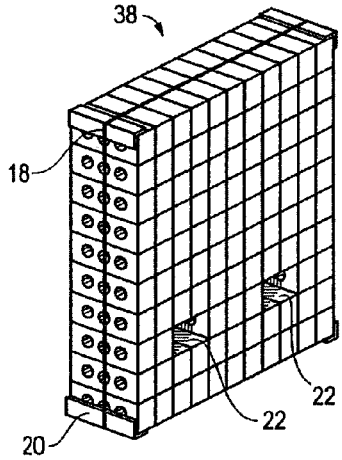
FIG. 2 is a perspective view of one vertical layer of bricks separated from the bundle of FIG. 1.

In addition to the enhanced stability and reduced "crush" afforded by the present void-board 12, an additional the benefit of the present board 12 is the ability to remove a vertical layer of bricks 38 (removed perpendicular to the direction of the fork prong openings as seen in FIG. 2), and to retain the board 12, in a clean-cut condition by separating along one of the weakened regions 36 to maintain the integrity of the remainder of the brick bundle 10.

In the disclosure, the use of the disjunctive is intended to include the conjunctive. The use of the definite article or indefinite article is not intended to indicate cardinality. In particular, a reference to "the" object or "a" object is intended to denote also one of a possible plurality of such objects.

All patents referred to herein, are hereby incorporated herein by reference, whether or not specifically done so within the text of this disclosure.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An extruded, rigid polymeric void-board for placement between adjacent horizontal layers of bricks to maintain an opening in a lower of the layers, the void-board comprising:

a relatively thin, rigid planar element having first and second surfaces having a plurality of parallel ribs extending from and generally transverse to the first side, the ribs having a curved, semi-cylindrical profile and having a predetermined height to width ratio and having a height that is less than a thickness of the planar element, the ribs being formed parallel to one another, the void board being formed from a polyolefin blend with a fibrous or particulate filler material, the void board including weakened regions formed in the planar element, in a single direction, generally parallel to the ribs and formed between selected ones of the ribs so as to provide a plurality of frangible regions for separating the board.

2. The void-board in accordance with claim 1 wherein the ribs are formed extending only from the first side.

3. The void-board in accordance with claim 1 wherein an on center distance between the ribs is about 0.10 inches to about and 0.20 inches.

4. The void-board in accordance with claim 3 wherein the on center distance is about 0.14 inches.

5. The void-board in accordance with claim 1 wherein the height to width ratio of the ribs is about 0.5.

6. void-board in accordance with claim 1 wherein the void-board is formed from polypropylene, polyethylene and a filler material.

7. The void-board in accordance with claim 6 wherein the polyethylene is a linear low density polyethylene.

8. The void-board in accordance with claim 6 wherein the filler material is a cellulose fiber material.

9. The void-board in accordance with claim 6 wherein the void-board is formed having a composition of about 50 percent to about 80 percent polypropylene, about 20 percentto about 40 percent linear low density polyethylene and about zero percent to about 10 percent filler material.

10. The void-board in accordance with claim 7 wherein the void-board is formed having a composition of about 65 percent polypropylene, about 30 percent linear low density polyethylene and about 5 percent filler material.

11. The void-board in accordance with claim 10 wherein the filler material is a cellulose fiber material.

* * * * *